US005892734A

United States Patent [19]

Flores et al.

[11] Patent Number: 5,892,734

[45] Date of Patent: Apr. 6, 1999

[54] MAGNETIC-BACKED TIME-INDICATING DEVICE

[76] Inventors: Amal Montez Flores; Melissa Kerry Dagodag, both of 2814 Roscomare Rd., Los Angeles, Calif. 90077

[21] Appl. No.: 876,463

[22] Filed: Jun. 16, 1997

Related U.S. Application Data

[63] Continuation of Ser. No. 383,852, Feb. 6, 1995, Pat. No. 5,680,372.

[51] Int. Cl.[6] ..... G04B 19/04; G04B 19/00; G04B 37/00

[52] U.S. Cl. ..... 368/80; 368/223; 368/316

[58] Field of Search ..... 364/76, 80, 88, 364/223, 228, 232, 234, 316, 317, 285

[56] References Cited

U.S. PATENT DOCUMENTS 3,807,236 4/1974 Lerne .
4,287,676 9/1981 Weinhaus .
4,310,908 1/1982 Fuerneisen .
4,320,483 3/1982 Vuilleumier .
5,375,102 12/1994 Schiaveliwi .

*Primary Examiner*—Vit Miska

[57] ABSTRACT

A timepiece is constructed of a hand assembly (16) including a clock movement (10) and hands (12). A magnet (18) is affixed to the hand assembly (16) so that the hand assembly (16) may be magnetically mounted on a ferrous metal object (28). In another version there is further provided magnetic ornamental indicator(s) (22) which indicate the time. Yet another version provides the hand assembly (16) including a clock movement (10) and hands (12) with a nonmagnetic adhesive (26) by which the hand assembly (16) affixes to the ferrous metal object (28). In this same version magnetic ornamental indicator(s) (22) may be further provided. In all versions of the timepiece construction an ornamental object (20) or ornamental ferrous metal object (24) may be further provided and attached to the clock movement (10) and hands (12), and the drive shaft (14) may extend through the ornamental object. In all versions of this timepiece construction wherein a magnet (18) is provided the magnet (18) may be affixed directly to the ornamental object (20) which partially surrounds the clock movement (10).

3 Claims, 6 Drawing Sheets

MAGNETIC-BACKED TIME-INDICATING DEVICE

RELATED APPLICATION

The present patent application is a continuation of U.S. patent application Ser. No. 08/383,852 filed Feb. 6, 1995, U.S. Pat. No. 5,680,372, which is incorporated herein by reference.

FIELD OF THE INVENTION

This invention relates generally to timepieces, and more particularly, to such timepieces which indicate the time with parts magnetically mounted on ferrous metal surfaces.

BACKGROUND OF THE INVENTION

Thomas J. Fuerneisen U.S. Pat. No. 4,310,908 (Jan. 12, 1982) and Mariano Schiavolini U.S. Pat. No. 5,375,102 (Dec. 20, 1994) both disclose the use of magnets in association with a time-indicating device; however, neither of these aforementioned patents discloses specifically analog time-indicating device which employs a magnetic means to affix the time-indicating device to a ferrous metal surface. While Mariano Schiavolini U.S. Pat. No. 5,375,102 (Dec. 20, 1994) discloses the use of magnets applied to an interchangeable decorative member, it does not disclose the use of magnets to adhere the entire time-indicating device to a mounting surface. While Thomas J. Fuerneisen U.S. Pat. No. 4,310,908 discloses the use of a magnetic means to adhere an electronic timepiece to a ferrous metal surface, it specifies solely a digital display element not an analog display element.

Timepieces commonly employ an electromagnetic means for setting time and for regulating the movement of various components. John M. Bergey U.S. Pat. No. 3,782,102 (Jan. 1, 1974) discloses a solid state watch with a magnetic setting. Two setting switches and a demand switch within the casing are operated from outside the watch by permanent magnets. William B. Beebe U.S. Pat. No. 4,723,233 (Feb. 2, 1988) discloses a magnetically controlled arrhythmical pendulum device.

Other timepieces have moveable, decorative components. Steve Feher U.S. Pat. No. 5,077,709 (Dec. 31, 1991) discloses a rotating timepiece dial face construction with moveable decorative objects.

SUMMARY OF THE INVENTION

However, none of the aforementioned U.S. Patents discloses the unique construction and combination of elements of the present invention. While John M. Bergey U.S. Pat. No. 3,782,102 (Jan. 1, 1974) discloses the use of magnets in setting a timepiece, it does not disclose the use of magnets in mounting a timepiece. While William B. Beebe U.S. Pat. No. 4,723,233 (Feb. 2, 1988) discloses the use of magnets in controlling pendulum movement, it does not disclose the use of magnets in mounting a timepiece. In addition, while Steve Feher U.S. Pat. No. 5,077,709 Dec. 31, 1991) discloses the use of moveable decorative objects located within a transparent chamber and a rotating ornamental dial face, the rotating elements of the face of the timepiece are not readily moveable or changeable. The objects which are said to be moveable are actually stuck within a sealed chamber. In addition, the objects disclosed in Steve Feher U.S. Pat. No. 5,077,709 (Dec. 31, 1991) are limited to minimal movement within the confines of the chamber, and they are not moveable as a result of magnetic adhesion.

Therefore, an easy and convenient alteration of the timepieces cited in John M. Bergey U.S. Pat. No. 3,782,102 (Jan. 1, 1974), William B. Beebe U.S. Pat. No. 4,723,233 (Feb. 2, 1988) and Steve Feher U.S. Pat. No. 5,077,709 (Dec. 31, 1991) is not possible. The timepieces cited in these aforementioned U.S. patents cannot be readily adjusted to suit varying aesthetic sensibilities. Neither do the timepieces cited in the aforementioned U.S. patents comprise many timepieces in one because none of the indicators used to mark the time can be physically added or removed altogether by the user of the timepiece. The indicators of the aforementioned U.S. Patents remain fixed on the faces of the timepieces, whereas the magnetic indicators used to mark the time in the present invention can be easily added or altogether removed.

Furthermore, the colors and shapes comprising the timepieces disclosed in the aforementioned U.S. patents cannot be easily altered without damage the timepieces. In the present invention however, the alteration of the colors and shapes of the magnetic indicators can be easily achieved without damage to the timepiece. In the present invention a magnetic indicator of a different color and shape can easily be incorporated into the timepiece by simply placing it on the ferrous surface where the hand assembly is mounted.

In addition, the timepieces disclosed in John M. Bergey U.S. Pat. No. 3,782,102 (Jan. 1, 1974), William B. Beebe U.S. Pat. No. 4,723,233 (Feb. 2, 1988) and Steve Feher U.S. Pat. No. 5,077,709 (Dec. 31, 1991) do not have as full a range of display possibilities as the present invention. The present invention can be displayed on a wall or table, as well as on any ferrous metal surface. By contrast, the timepieces disclosed in these aforementioned U.S. patents have a restricted range of display possibilities since they do not magnetically adhere to any ferrous metal surface.

Furthermore, Thomas J. Fuemeisen U.S. Pat. No. 4,310,908 specifically discloses the use of a magnetic means to adhere an electronic timepiece with a digital display to a ferrous metal surface. This digital display element is limited in a manner in which the present invention is not. The present invention, having an analog display, possesses the distinct advantage of being easily visible at a significant distance away from the time-indicating device. The hands of the time-indicating device disclosed in the present invention can be painted a color which sharply contrasts with the color of the ferrous mounting surface, so as to be easily discerned. However, the display of the timepiece disclosed in Thomas Fuerneisen U.S. Pat. No. 4,310,908 is limited by LCD technology which allows for a tone-on-tone display which is more difficult to see at a distance.

It is accordingly a primary aim and object of the present invention, Magnetic Backed Time Indicating Device, to provide a timepiece with magnetic-backed parts that indicate the time.

In accordance with one embodiment of the present invention, a hand assembly is provided with a magnet by which the hand assembly adheres magnetically to ferrous metal objects. An ornamental metal or non-metal object may be provided and located between the hands and the clock movement. Generally, the drive shaft for the time piece extends through a central opening in the ornamental metal or non-metal object. The hands mounted thereon are spaced outwardly from the outer surface of the ornamental metal or non-metal object.

In accordance with another embodiment of the present invention, an ornamental metal or non-metal object may be provided and located between the hands and the clock movement, wrapping around and encasing the clock movement. In this particular embodiment, the ornamental metal or non-metal object is provided with a magnet. Rather than applying the magnet directly to the clock movement, the magnet is applied to the ornamental metal or non-metal object which either fully or partially surrounds the clock movements In this particular embodiment the ornamental metal or non-metal object provides the surface to which the magnet adheres.

The timepiece may also be provided with magnetic indicators the mark the time. These magnetic indicators may be positioned on the ornamental object located between the clock movement and the hands provided that the ornamental object is comprised of ferrous metal. The magnetic indicators may also be positioned upon a different ferrous metal surface distinct from the ornamental object located between the clock movement and the hands.

In accordance with another embodiment of the present invention, the ornamental ferrous metal object located between the clock movement and hands is free-standing. Provided with no magnet in this version, the hand assembly is fixed to the ornamental ferrous metal object through which the drive shaft extends. In this tabletop version of the timepiece the magnetic indicators that mark the time are positioned on the ornamental ferrous metal object.

In accordance with another embodiment of the present invention, the hand assembly is provided with a non-magnetic adhesive backing which adheres non-magnetically to ferrous and other surfaces. In addition, magnetic indicators that mark the time are provided. As in the first embodiment of the invention, the entire timepiece may be mounted on a ferrous metal surface, such as a refrigerator or a file cabinet.

These and other features and advantages of the present invention are described by the following detailed description of the preferred embodiments together with the accompanying drawings.

Reference Numerals in Drawings

10 clock movement

12 hands

14 drive shaft

16 hand assembly

18 magnet

20 ornamental object

22 magnetic ornamental indicator

24 ornamental ferrous metal object

26 non-magnetic adhesive

28 ferrous metal object

Detailed Description of the Invention

Figure 1:
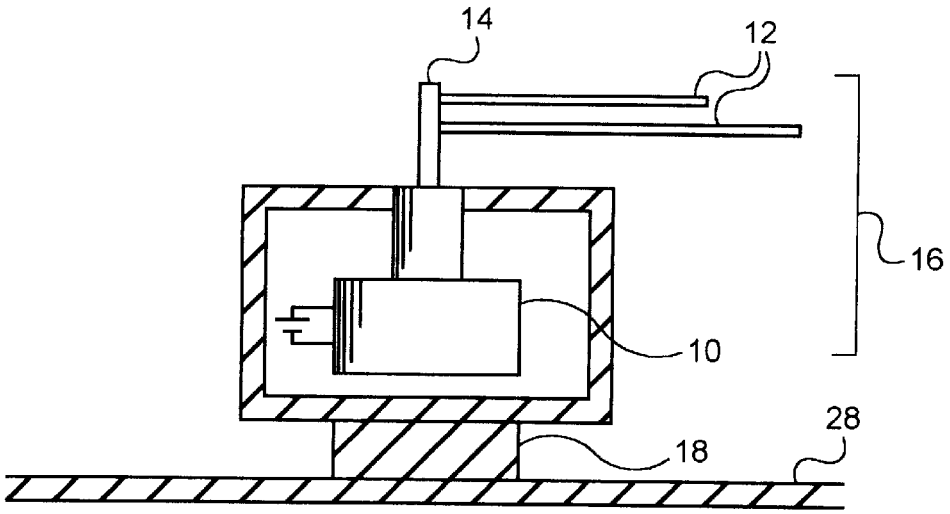
FIGS. 1 and 2 show various aspects of a timepiece including a hand assembly with a magnetic backing.
Figure 2:
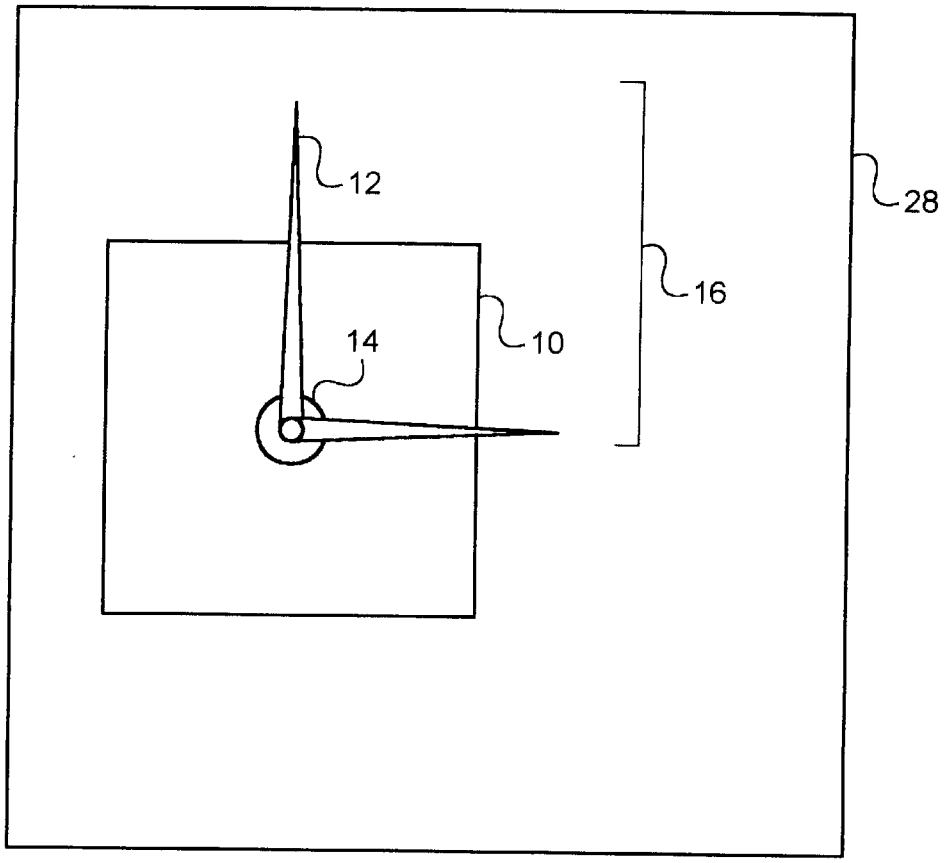

With reference now to the drawings and particularly FIG. 1, a sectional view of a timepiece is shown with a hand assembly 16, including the clock movement 10, hands 12 and drive shaft 14, having a magnet 18 attached. FIG. 2 shows a frontal view of this timepiece. The magnetic mounting of the timepiece to a ferrous metal object 28, such as a refrigerator or a file cabinet, is achieved without interfering with the normal operation of the timepiece.

Figure 3:
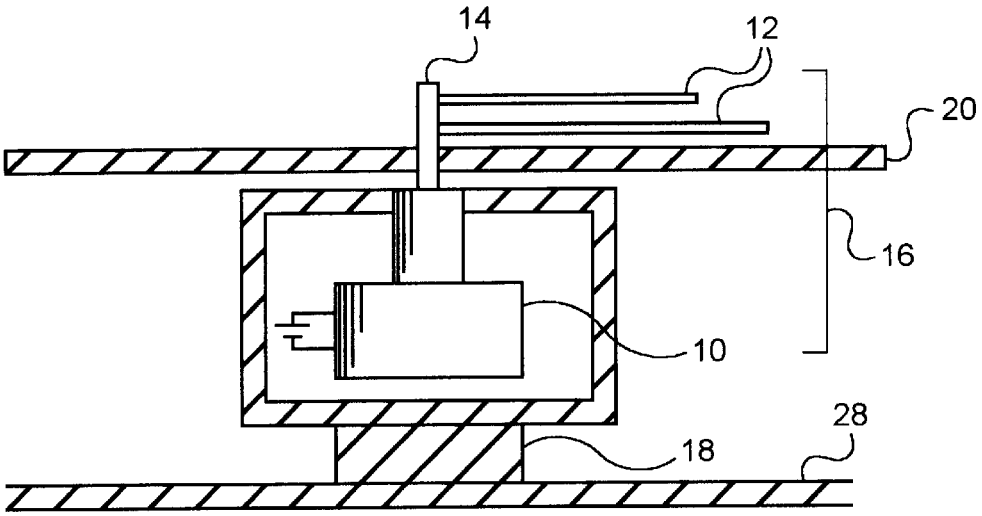
FIGS. 3 and 4 show various aspects of a similar timepiece with an ornamental metal or non-metal object which may fully or partially wrap around the clock movement and through which a drive shaft extends with hands located thereupon.
Figure 4:
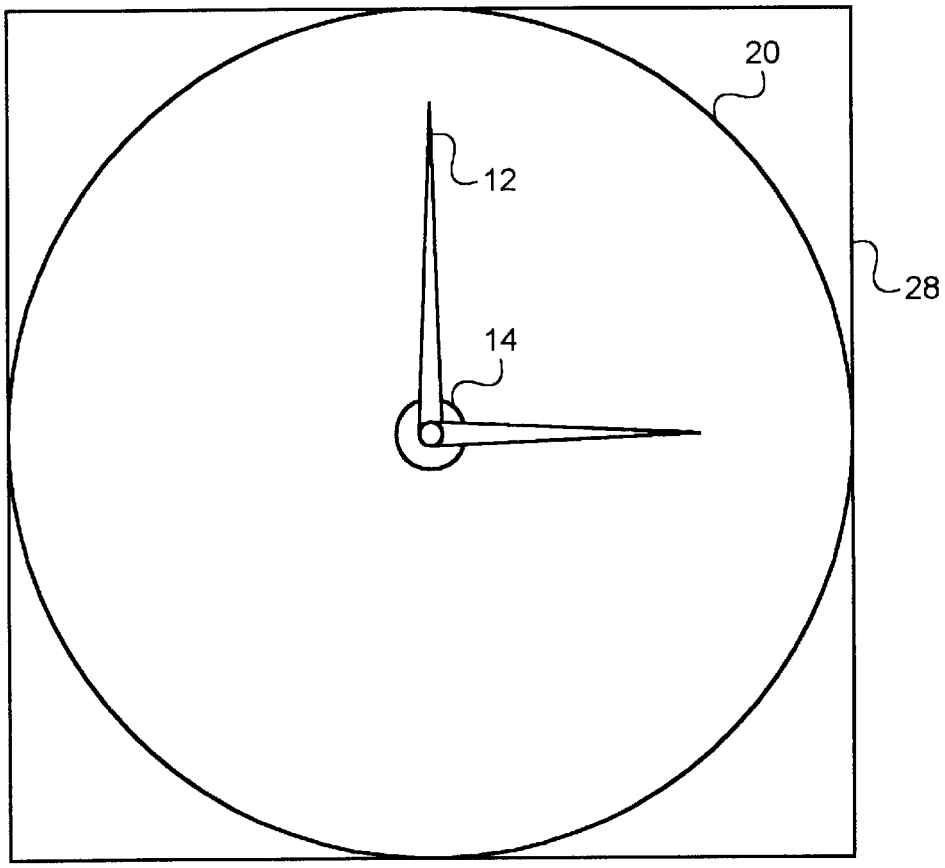

As can be seen in FIGS. 3 and 4 the clock movement 10 and hands 12 may be attached to an ornamental object 20, metal or non-metal, through which the drive shaft 14 extends and the hands 12 located thereon. The hands 12 located thereon may be spaced outwardly from the outer surface of the ornamental object 20.

Figure 5:
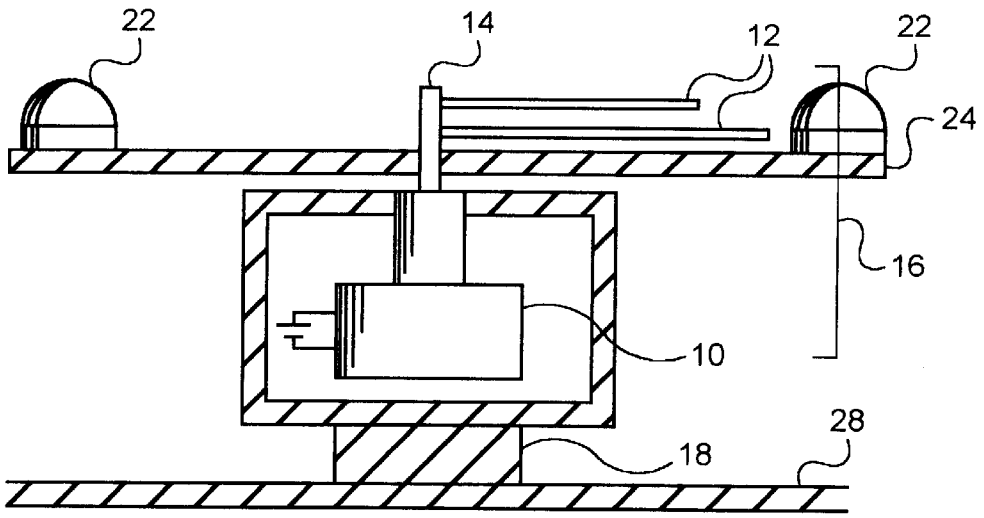
FIGS. 5 and 6 show a similar timepiece with a ferrous metal object through which a drive shaft extends with hands located thereon and upon which magnetic ornamental hour indicators are located.
Figure 6:
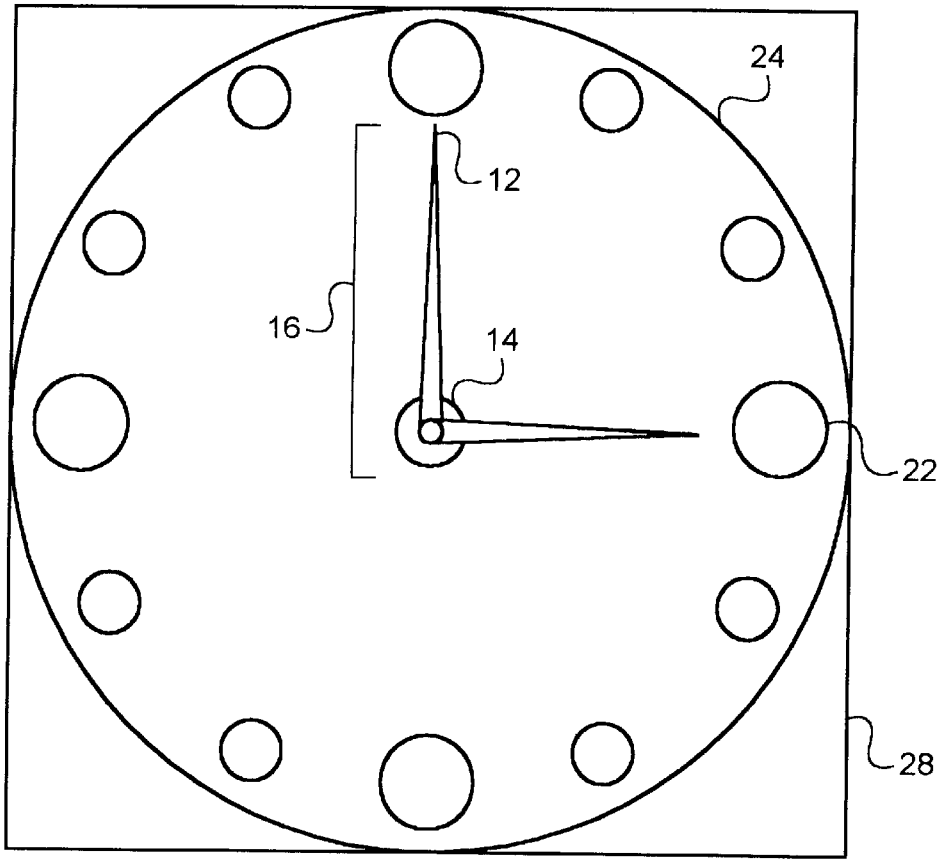

The timepiece of FIGS. 5 and 6 includes not only a clock movement 10, hands 12, drive shaft 14, magnet 18, and ornamental ferrous metal object 24, but also magnetic ornamental indicator(s) 22. The(se) magnetic ornamental indicator(s) 22 may be constructed of any solid material which is either a magnet in and of itself or to which a magnet can be affixed, thereby rendering the ornamental indicator(s) magnetic. In this version of the timepiece the magnetic ornamental indicator(s) 22 may be positioned on the ornamental ferrous metal object 24 to which the hand assembly 16 is affixed and through which the drive shaft 14 extends.

Figure 7:
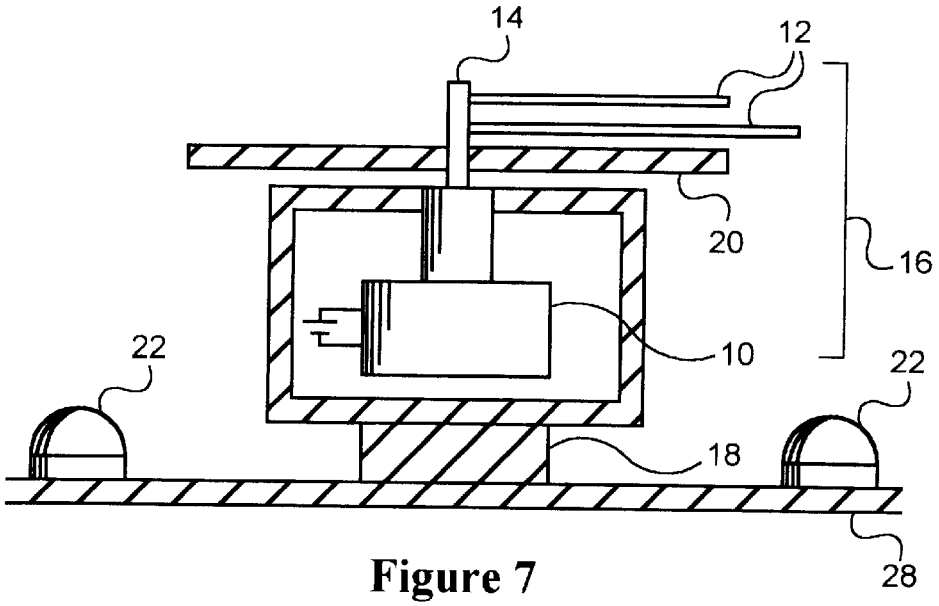
FIGS. 7 and 8 show various aspects of a timepiece including a hand assembly with a magnetic backing and magnetic ornamental hour indicators all of which are positioned on a ferrous metal object.
Figure 8:
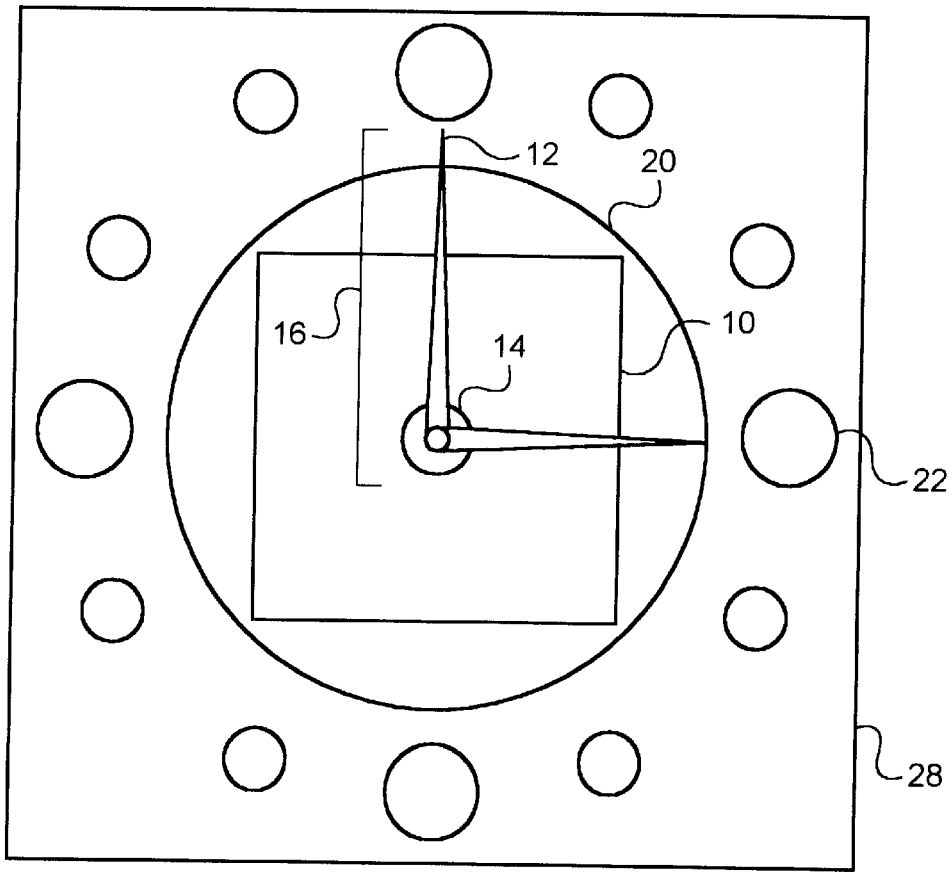

Optionally the timepiece of FIGS. 7 and 8 may be constructed with or without an ornamental object 20 through which the drive shaft 14 extends. The timepiece is constructed so that the hand assembly 16 and affixed magnet 18 may be positioned on a ferrous metal object 28, such as a refrigerator. The magnetic ornamental indicator(s) 22 may also be positioned on the ferrous metal object 28 in peripheral pattern surrounding the hand assembly 16 and affixed magnet 18.

Figure 9:
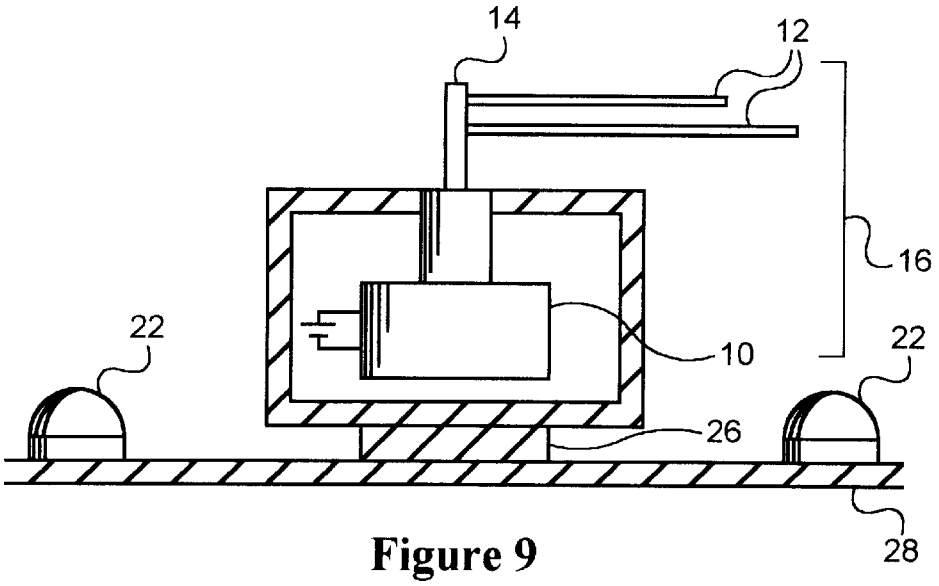
FIGS. 9 and 10 show various aspects of a timepiece including a hand assembly with a non-magnetic adhesive backing and magnetic ornamental hour indicators all of which are positioned on a ferrous metal object.
Figure 10:
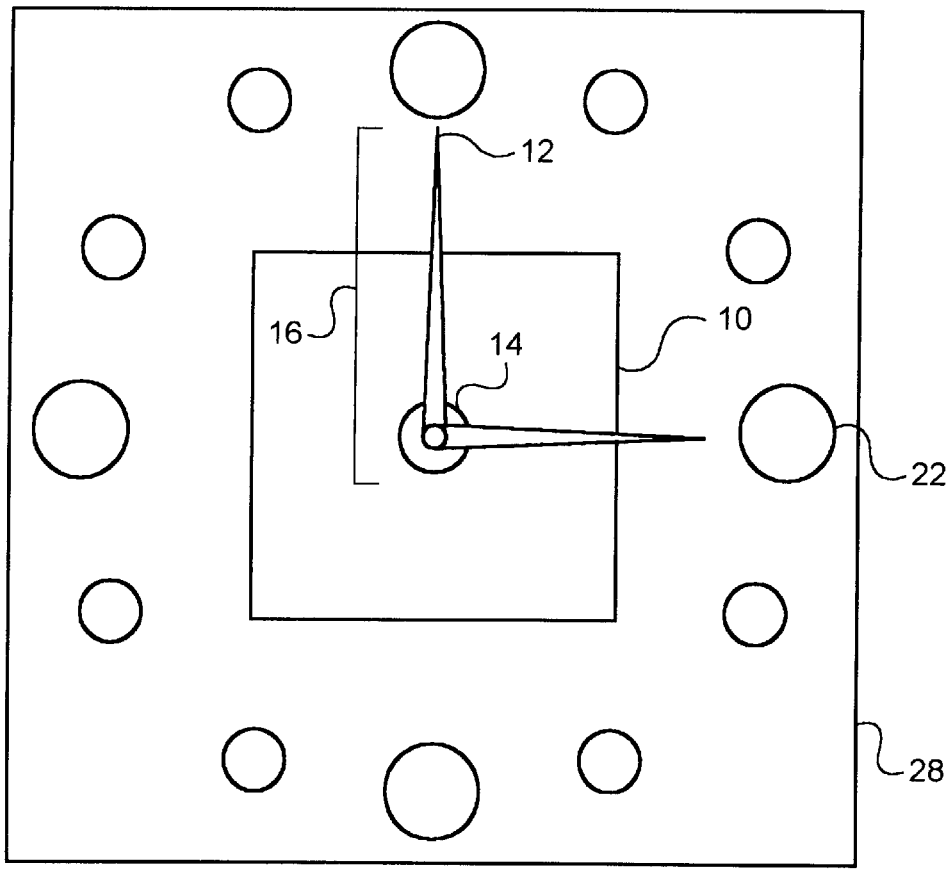

As can be seen in FIGS. 9 and 10 in a different version the timepiece may be constructed of a hand assembly 16 with a backing of non-magnetic adhesive 26. The magnetic ornamental indicator(s) 22 and the hand assembly 16 with a backing of nonmagnetic adhesive 26 may be positioned on a ferrous metal object 28. The hand assembly 16 of this version of the timepiece therefore adheres to the ferrous metal object 28 non-magnetically, while the ornamental magnetic indicator(s)22 adhere magnetically.

Figure 11:
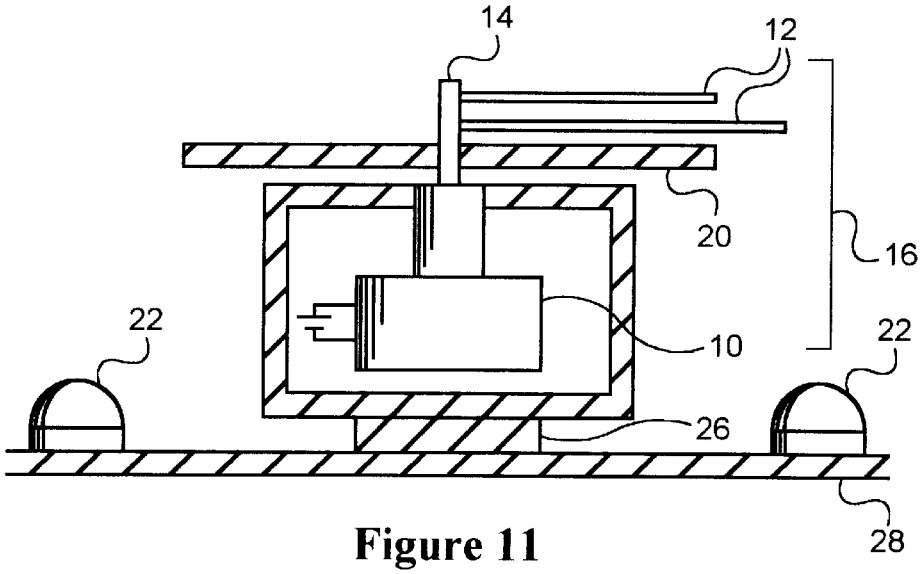
FIGS. 11 and 12 show various aspects of a similar timepiece with an ornamental object through which the drive shaft extends with hands located thereupon.
Figure 12:
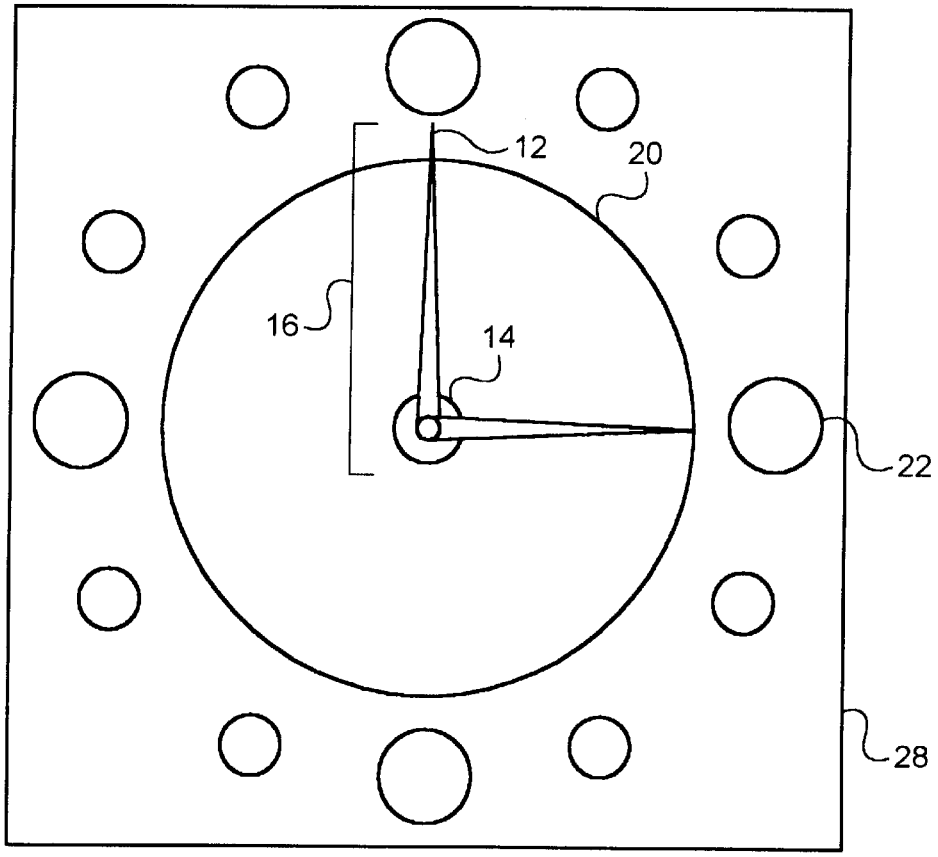

In FIGS. 11 and 12 a similar timepiece to FIGS. 9 and 10 is constructed with the addition of an ornamental object 20, metal or non-metal, through which the drive shaft 14 extends with the hands 12 located thereon.

Although the description above contains some specificities, these should not be construed as limiting the scope of the invention, but as merely providing illustrations of some of the presently preferred embodiments of this invention. For example, the timepiece may have a vast variety of magnetic ornamental indicators constructed of plastic, wood or other materials, but it does not need to have any magnetic ornamental indicators at all. The hand assembly may simply have a magnetic backing without any inclusive magnetic ornamental indicators that mark the time. The magnetic-backed hand assembly may be mounted alone or in conjunction with magnetic ornamental indicators. Also, the ornamental object located between the hand assembly and hands and through which the drive shaft extends is not limited in shape or size. Magnet may be directly adhered to the hand assembly, or magnet may be adhered to the ornamental metal or non-metal object which may partially or completely encase the clock movement. Thus, the scope of this invention should be determined by the appended claims and their legal equivalents, rather than by the examples given.

We claim:

1. A timepiece construction comprising:

a hand assembly including a clock movement, drive shaft and hands;

a magnetic means affixed to said hand assembly for adhering to ferrous metal surfaces; and a magnetic ornamental indicator means for indicating the time when mounted in conjunction with said hand assembly.

2. A timepiece construction comprising a clock movement, drive shaft and hands and non-magnetic adhesive means for affixing said hand assembly to a ferrous metal object, wherein a magnetic ornamental indicator means for indicating the time are further provided.

3. A timepiece construction comprising:

a hand assembly including a clock movement, drive shaft and hands;

a magnetic means affixed to said hand assembly for adhering to ferrous metal surfaces;

an ornamental object means for entirely or partially concealing said hand assembly and to which said clock movement and said hands are attached and through which said drive shaft extends; and a magnetic ornamental indicator means for indicating time;

said ornamental object means being constructed of ferrous metal, thereby providing an ornamental ferrous metal object for adhering to said magnetic ornamental indicator.

* * * * *